US007114426B2

(12) United States Patent
Francitorra

(10) Patent No.: US 7,114,426 B2
(45) Date of Patent: Oct. 3, 2006

(54) SPINDLE FOR BRAIDING MACHINE

(75) Inventor: Josep Ratera Francitorra, Barcelona (ES)

(73) Assignee: Talleres Ratera, SA, Manresa (ES)

( * ) Notice: Subject to any disclaimer, the term of this patent is extended or adjusted under 35 U.S.C. 154(b) by 0 days.

(21) Appl. No.: 10/527,240

(22) PCT Filed: Sep. 10, 2003

(86) PCT No.: PCT/ES03/00455

§ 371 (c)(1),
(2), (4) Date: Mar. 9, 2005

(87) PCT Pub. No.: WO2004/022829

PCT Pub. Date: Mar. 18, 2004

(65) Prior Publication Data

US 2006/0042457 A1 Mar. 2, 2006

(30) Foreign Application Priority Data

Sep. 9, 2002 (ES) ..... 200202187 U

(51) Int. Cl.
*D04C 3/14* (2006.01)

(52) U.S. Cl. ..... 87/33; 87/55

(58) Field of Classification Search ..... 87/33, 87/55, 56, 62

See application file for complete search history.

(56) References Cited

U.S. PATENT DOCUMENTS

| | | | | |
|---|---|---|---|---|
| 5,383,387 | A * | 1/1995 | Chesterfield et al. | 87/56 |
| 5,732,611 | A * | 3/1998 | Voyer et al. | 87/56 |
| 6,360,644 | B1 | 3/2002 | Bettger et al. | 87/33 |
| 6,810,785 | B1 * | 11/2004 | Chen | 87/56 |

FOREIGN PATENT DOCUMENTS

| | | |
|---|---|---|
| ES | 1017406 U | 12/1991 |
| ES | 2082096 T | 3/1993 |
| WO | WO91/17294 | 11/1991 |

* cited by examiner

*Primary Examiner*—Shaun R. Hurley
(74) *Attorney, Agent, or Firm*—Fleshner & Kim LLP.

(57) ABSTRACT

A spindle for a braiding machine includes a stem mounted on a base, a disc on the stem, and a reel of thread mounted on the step atop the disc. A thread guide is mounted on two columns adjacent the stem. A capsule mounted on the top of the columns includes a spring that biases the thread guide downward. The capsule includes an opening which is large enough such that the spring can be inserted into and removed from the opening in the capsule. A washer can be included between the base and the disc to reduce wear to the base and the disc. Also, a single piece reel head may be mounted on the top of a reel of thread.

20 Claims, 2 Drawing Sheets

SPINDLE FOR BRAIDING MACHINE

This invention relates to a spindle for braiding machine, which includes a spindle foot, a stem that threads a reel of thread, thread guides and tensors, a thread support-guide that slides on columns supporting a tube or capsule at the top end of which there is hinged a collapsible, raisable part that secures the top end of the reel, with said capsule housing a spring including an inner core that via a rod arranged head to head with said core, pushes said sliding thread support-guide, with an opening having been provided in said capsule that is large enough to introduce and remove said spring from said capsule therethrough.

BACKGROUND TO THE INVENTION

The proposed invention provides an improvement to a spindle described in an existing utility model in the name of the same owner, TALLERS RATERA, S. A., under No. 9101469/7 for "IMPROVED SPINDLE FOR BRAIDING MACHINES".

The new spindle is contemplated as an improvement of some component parts of the one described in said prior utility model, which is the result of the experience and observations made over several years using the spindle in question.

In particular, the company TALLERES RATERA, S. A. has discovered that the system for removing the spring that charges the rod attached to said sliding thread support-guide was a complicated and delicate task, said spring-charged rod having to be released, by gripping it at one of its ends and removing it from a recess provided in the thread support-guide compressing said spring, in order to subsequently, by increasing the compression of the spring, move the rod towards the outside, finally removing the spring from its housing through the lower part of the capsule. In other words, this meant dismantling and/or handling various parts in order to remove said spring from inside its housing in the capsule.

Also, sometimes, with the previous arrangement there was also the risk of said spring "springing" because it was not retained properly in its seat.

Another aspect which has proved problematic concerns the cap-like upper nylon bush or reel head (or boxer), designated in said Utility Model No. 9101469 with reference number 29 and which is produced in three parts although no specific details of this are provided in said model. The use of said bush in the spindle mentioned in said prior utility model has shown wear and tear problems and has meant that the tasks for assembling and dismantling said cap were slightly slow. Due to all this, the applicant has considered it necessary to improve said spindle providing a suitable solution to the mentioned problems.

BRIEF DESCRIPTION OF THIS INVENTION

This invention provides a development in the field of spindles for thread braiding machines, particularly in terms of their maintenance, reliability and decrease in production down times, by providing means that facilitate that the spindles are always in an optimum condition for fulfilling their purpose.

Therefore in view of the problems mentioned in the background to the invention, the improvements made to the spindle of this invention are basically focused on three points.

On the one hand, modifications have been made to the system for removing the spring that controls the upward and downward movement of said thread support-guide that slides on columns. In line with the solution proposed herein, it suffices to use a small die or punching element to remove the spring through a window suitably dimensioned for this purpose (which also enables the introduction of said spring), provided in the side wall of the housing of said spring inside the tube or capsule supported by said columns and that extends parallel to the stem and is separated therefrom.

In this way said spring can be removed and positioned easily and quickly, reducing the necessary time (it has to be taken into account that the braiding machines generally have a large number of spindles) and also avoiding stoppages in the machinery because said spring has been positioned incorrectly.

Also the upper nylon bush or reel head has been modified, and is now manufactured as a single part using treated steel which allows the operators to make quick changes and reduces the wear and tear of the whole ensemble (stem and axial element of the collapsible part that is introduced into the bush) and the bush proper.

Lastly (and although not shown in the drawings), it is envisaged to use bushings between the stem and the metallic spindle axis so that the device can be self-lubricated permanently by means of metallic particles, thus avoiding erosion.

BRIEF DESCRIPTION OF THE DRAWINGS

In order to facilitate the explanation, this specification includes two sheets of drawings showing a non-limiting example of a practical embodiment of the scope of this invention.

SPECIFIC EMBODIMENT OF THE PATENT OF INVENTION UNDER APPLICATION

Figure 1:
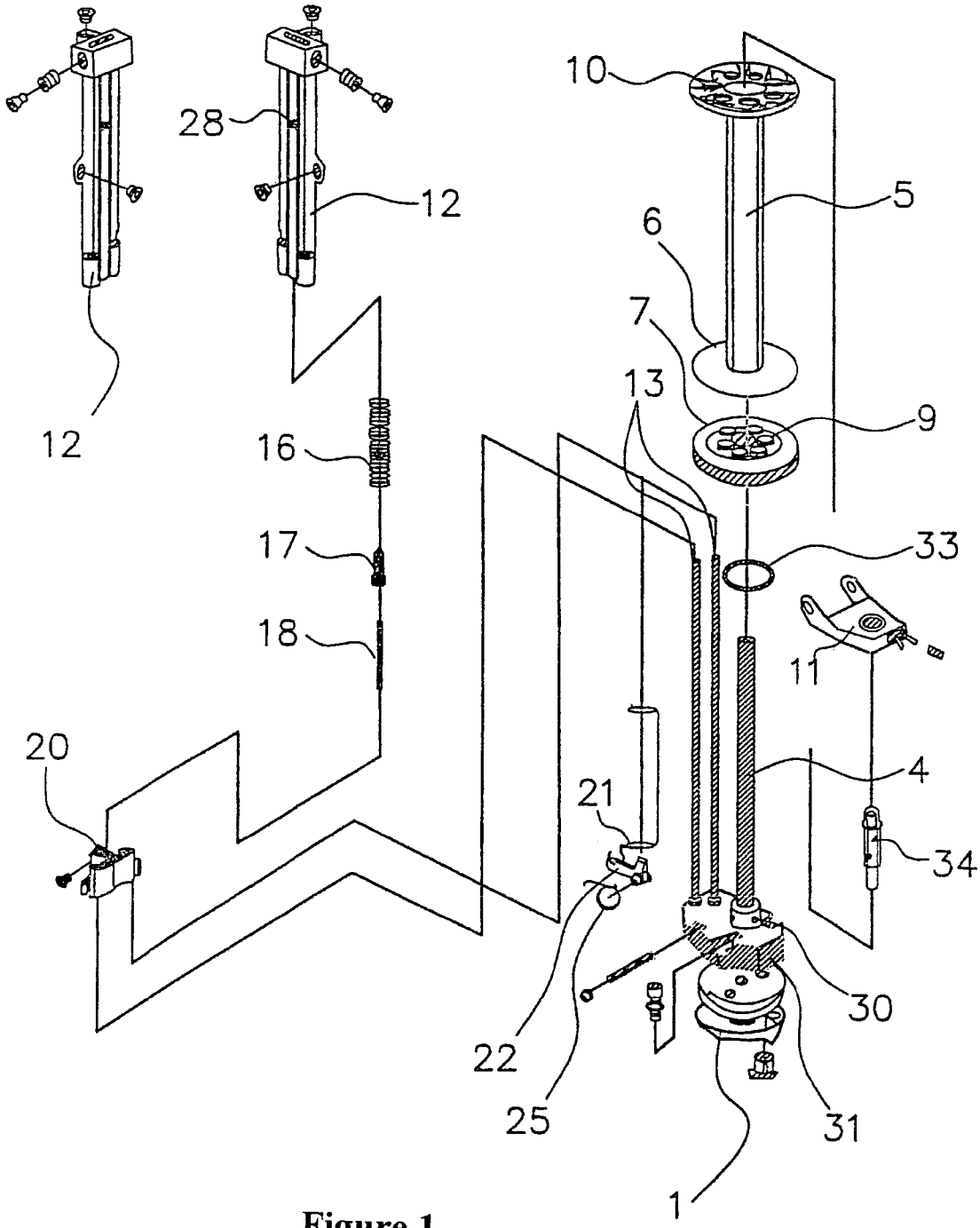
FIG. 1 is an exploded view of this invention.

So FIG. 1 illustrates the body of the spindle with a general structure that coincides substantially with that described in said Utility Model No. 9101469/7 and comprising a foot 1, a stem 4 for threading a reel of thread, a bush 30, a base 31, a washer 33, a spindle disc 7 with pivots 9 (that couple with recesses in said disc 7), a reel 5 with a lower end 6 and a top end 10, a collapsible and raisable part 11 (for retaining the reel head), columns 13 along which a thread-guide 20 is moved in a sliding fashion, a tensing wire 21 that is drawn by said thread-guide 20 when it reaches the top end of its stroke and the lower end of which activates a toggled lever 22 charged by a torsion spring 25, releasing the disk 7 (and allowing it to rotate) and a rod 18 against which there is arranged head to head an inner core 17 of a spring 16 housed inside a capsule 12 provided with an opening or window 28.

Figure 2:
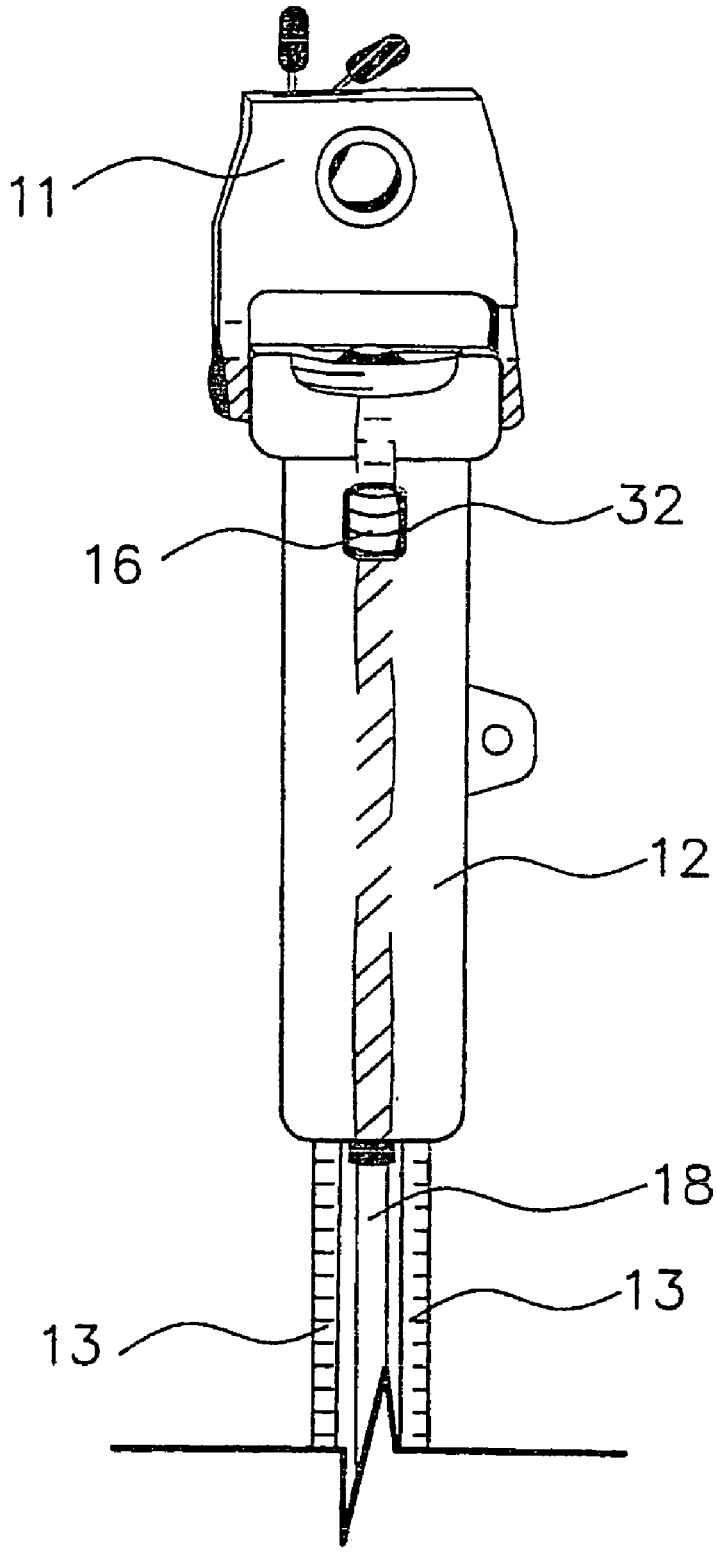
FIG. 2 is a detail of the spring mechanism seen from behind.

Furthermore, FIG. 2 illustrates said capsule 12, the collapsible and raisable part 11 (in raised position), the columns 13, said rod 18 and an opening 32 through the inside of which the above-mentioned spring 16 can be seen that controls the up and down movement of the thread-guide 20.

As far as the operation of said spindle is concerned, this party refers to the explanation given in said Utility Model No. 9101469/7, since said operation has not varied except for the details indicated above that are explained below in greater detail.

So, said opening 32 made in the capsule 12, has a scale or passage that makes it possible to position said spring 16 inside said capsule 12 therethrough. To be precise, the operator can accompany this manoeuvre with a punching element (not shown) that will push said spring 16 downwards.

If it is necessary to remove said spring 16 from inside the capsule 12, simply with the afore-mentioned punching element it is easy to remove said spring 16 through the opening 32, saving a considerable amount of time and handling in comparison with Utility Model No. 9101469/7.

At the same time through said opening 32 the necessary lubrication of said spring 16 can be carried out, as in the prior model.

Also a washer 33 has been introduced that prevents the wear and tear of the discoidal plate 7 with the base 31, by lodging itself in between the two.

In each of the reel ends 10 and 6 a bushing has been introduced to prevent corrosion of the stem or axis 4 when the ensemble rotates.

Also the cap or reel head 34 has been made as a single part from treated steel, whereas previously, as indicated, it consisted of three parts, thus improving wear resistance.

All these improvements mean that said spindle has developed considerably and has improved the features of the utility model filed in 1991 by the same applicant.

After reading the explanation provided, it is noted that this patent of invention describes a new spindle for braiding machines and that the example mentioned herein is non-limiting. Therefore it can include different shapes of its component parts and/or adaptations, all within the scope of the following claims.

The invention claimed is:

1. A spindle for a braiding machine, comprising:

a stem mounted on a base and that is configured to receive a reel of thread;

a disc configured to be positioned under a reel of thread mounted on the stem and that rotates around said stem with the reel of thread;

a lever mounted on the base and configured to control rotation of the disc on the stem;

a pair of columns mounted on the base;

a thread support-guide that slides on the columns, wherein a downward movement of the thread support guide will move the lever;

a capsule mounted on the pair of columns;

a rod coupled to the thread support-guide;

a core coupled to the rod;

a spring mounted inside the capsule and coupled to the core; and a collapsible and raisable part hingedly mounted on the capsule and that is configured to secure a top end of a reel of thread mounted on the stem, wherein said capsule includes an opening having dimensions that allow the spring to be inserted into and removed from the capsule through the opening.

2. The spindle of claim 1, characterised in that it includes an element, a single piece made from treated steel, acting as the reel head and in which a projection of said collapsible and raisable part is introduced.

3. The spindle of claim 2, characterised in that it includes a washer arranged coaxially to said stem, and which is positioned between the disc and the base of the spindle, preventing wear and tear.

4. The spindle of claim 1, characterised in that it includes a washer, arranged coaxially to said stem and which is positioned between the disc and the base of the spindle, preventing wear and tear.

5. The spindle of claim 4, characterised in that each of the ends of the reel include a bushing to prevent erosion of the stem when the ensemble rotates.

6. The spindle of claim 1, further comprising a tensing wire mounted between the thread guide and the lever.

7. The spindle of claim 1, further comprising a spring configured to bias the lever into a predetermined position.

8. A spindle for a braiding machine, comprising:

a stem mounted on a base and that is configured to receive a reel of thread;

a disc configured to be positioned under a reel of thread mounted on the stem and that rotates around said stem with the reel of thread;

a lever mounted on the base and configured to control rotation of the disc on the stem;

at least one column mounted on the base;

a thread guide that slides on the at least one column, wherein a downward movement of the thread guide will cause the lever to move;

a capsule mounted on the at least one column; and a spring mounted on the capsule and configured to bias the thread guide downward, wherein said capsule includes an opening having dimensions that allow the spring to be inserted into and removed from the capsule through the opening.

9. The spindle of claim 8, further comprising a lever spring that biases the lever into a predetermined position.

10. The spindle of claim 9, further comprising a tensing wire mounted between the thread guide and the lever and configured such that downward movement of the thread guide against the tensing wire cause the tensing wire to move the lever against the bias of the lever spring.

11. The spindle of claim 8, further comprising a tensing wire mounted between the thread guide and the lever and configured such that downward movement of the thread guide against the tensing wire cause the tensing wire to move the lever.

12. The spindle of claim 8, further comprising a washer located between the base and the disc.

13. The spindle of claim 8, further comprising a cap that is pivotally mounted on the capsule and that is configured to bear against a top of a reel of thread mounted on the stem to retain the reel of thread in place on the stem.

14. The spindle of claim 13, further comprising a reel head configured to be positioned between the cap and a reel of thread mounted on the stem, wherein the reel head is a single piece made from treated steel.

15. The spindle of claim 14, wherein the reel head is configured to be mounted inside a central aperture of a reel of thread, and wherein a depression in the reel head receives a projection on the cap.

16. The spindle of claim 8, further comprising:

a rod that bears against the top of the thread guide; and a core, wherein a bottom of the core bears against a top of the rod, and wherein a top of the core bears against the spring.

17. The spindle of claim 16, wherein the top of the core is inserted into a bottom of the spring.

18. The spindle of claim 8, wherein the at least one column comprises a pair of columns, wherein the thread guide is mounted on and moves along the pair of columns, and wherein the capsule is mounted on the top of the pair of columns.

19. The spindle of claim 18, further comprising:

a cap that is pivotally mounted on the capsule and that is configured to bear against a top of a reel of thread mounted on the stem to retain the reel of thread in place on the stem; and a reel head configured to be positioned between the cap and a reel of thread mounted on the stem, wherein the reel head is a single piece made from treated steel.

20. The spindle of claim 19, wherein the reel head is configured to be mounted inside a central aperture of a reel of thread, and wherein a depression in the reel head receives a projection on the cap.

* * * * *